US006206246B1

(12) United States Patent
Bougamont et al.

(10) Patent No.: US 6,206,246 B1
(45) Date of Patent: Mar. 27, 2001

(54) DEVICE FOR PRE-POSITIONING A COVERING COLLAR ON A PUSHBUTTON

(75) Inventors: Jean-Louis Bougamont, Eu; Hervé Lompech, Incheville; Pierre Dumont, Eu, all of (FR)

(73) Assignee: Rexam Sofab, Le Treport (FR)

( * ) Notice: Subject to any disclaimer, the term of this patent is extended or adjusted under 35 U.S.C. 154(b) by 0 days.

(21) Appl. No.: 09/647,913

(22) PCT Filed: Apr. 13, 1999

(86) PCT No.: PCT/FR99/00859

§ 371 Date: Oct. 13, 2000

§ 102(e) Date: Oct. 13, 2000

(87) PCT Pub. No.: WO99/52786

PCT Pub. Date: Oct. 21, 1999

(30) Foreign Application Priority Data

Apr. 14, 1998 (FR) ..... 98 04613

(51) Int. Cl.[7] ..... B67D 5/40
(52) U.S. Cl. ..... 222/321.9
(58) Field of Search ..... 222/321.9, 321.7, 222/321.6, 321.1, 385

(56) References Cited

U.S. PATENT DOCUMENTS

| | | | | |
|---|---|---|---|---|
| 4,773,553 | * | 9/1988 | Van Brocklin | 222/321 |
| 5,348,174 | * | 9/1994 | Velicka | 215/277 |
| 5,642,908 | * | 7/1997 | Mascitelli | 222/321.9 |
| 5,799,810 | * | 9/1998 | de Pous et al. | 222/321.9 |
| 5,941,428 | * | 8/1999 | Behar et al. | 222/321.7 |

FOREIGN PATENT DOCUMENTS

0653359 * 5/1995 (EP) .

* cited by examiner

*Primary Examiner*—Kevin Shaver
*Assistant Examiner*—Patrick Buechner
(74) *Attorney, Agent, or Firm*—Bacon & Thomas, PLLC

(57) ABSTRACT

A dispensing device mountable on a tank having a sheathed pushbutton and movable collar. The collar having a first, temporary, high position on the pushbutton and being held in place frictionally by at least two projection members on the interior face of the collar in contact with the pushbutton. The collar having a second, low position and being held in place by catches cooperating with the neck of the tank.

7 Claims, 2 Drawing Sheets

DEVICE FOR PRE-POSITIONING A COVERING COLLAR ON A PUSHBUTTON

The present invention relates to a device for dispensing a liquid from a tank.

More precisely, the invention applies to dispenser devices comprising: firstly a pump 1 provided, in particular, with a cylindroconical body fixed in the tank and a spray tube that projects out from the body and capped by a pushbutton; and secondly a collar for covering the pump and fixed in a low position on the neck of the tank.

In general, the pump body has an upper shoulder extending via a horizontal annular plate designed to support the covering collar during storage and transport of the device and before said device is assembled on the tank that has previously been filled with liquid.

However, because various tank-neck formats exist, covering collars have to be made to match a variety of dimensions.

In such conditions, it is also necessary to provide a pump body in as many versions as there are collars and neck diameters.

Consequently, it is necessary to have a series of molds for manufacturing the pump bodies and a plurality of assembly machines adapted to the various bodies.

That situation is thus disadvantageous from an economic point of view and harmful to the productivity of the manufacturing and assembly chains.

An object of the present invention is to resolve the technical problems in satisfactory manner.

The invention achieves this object by means of a dispenser device of the above type in which the collar includes, on its inside face, projecting members that enable said collar to be held temporarily in a high position by radial clamping on the outside face of the pushbutton.

SUMMARY OF THE INVENTION

According to an advantageous characteristic, said projecting members are constituted by at least two diametrically opposite bumps each having a contact face that is at least partially cylindrical and that is substantially parallel to the facing outside face of the pushbutton.

According to another characteristic, the outside of the pushbutton is sheathed in a sheath made of a material such that its coefficient of friction with the projecting members enables the collar to be held.

According to yet another characteristic, said collar includes snap-fastening members designed to co-operate with a peripheral rim formed on the neck of the tank.

In a specific embodiment, said snap-fastening members are constituted by at least two catches carried by the inside face of said collar.

The snap-fastening members are angularly offset relative to the holding members.

In a variant, the outside of the collar is also sheathed in a sheath.

The present invention makes it possible to eliminate the numerous pump-body versions that were necessary with conventional devices, retaining only a single standard embodiment having a single diameter of plate that matches any tank.

Holding the collar in a high position is now ensured by radially clamping said collar on the pushbutton and no longer on the pump body, thereby simplifying the assembly operations and also offering mechanical protection to the pushbutton.

The invention will be better understood on reading the following description accompanied by the drawings.

DETAILED DESCRIPTION OF THE INVENTION

Figure 1:
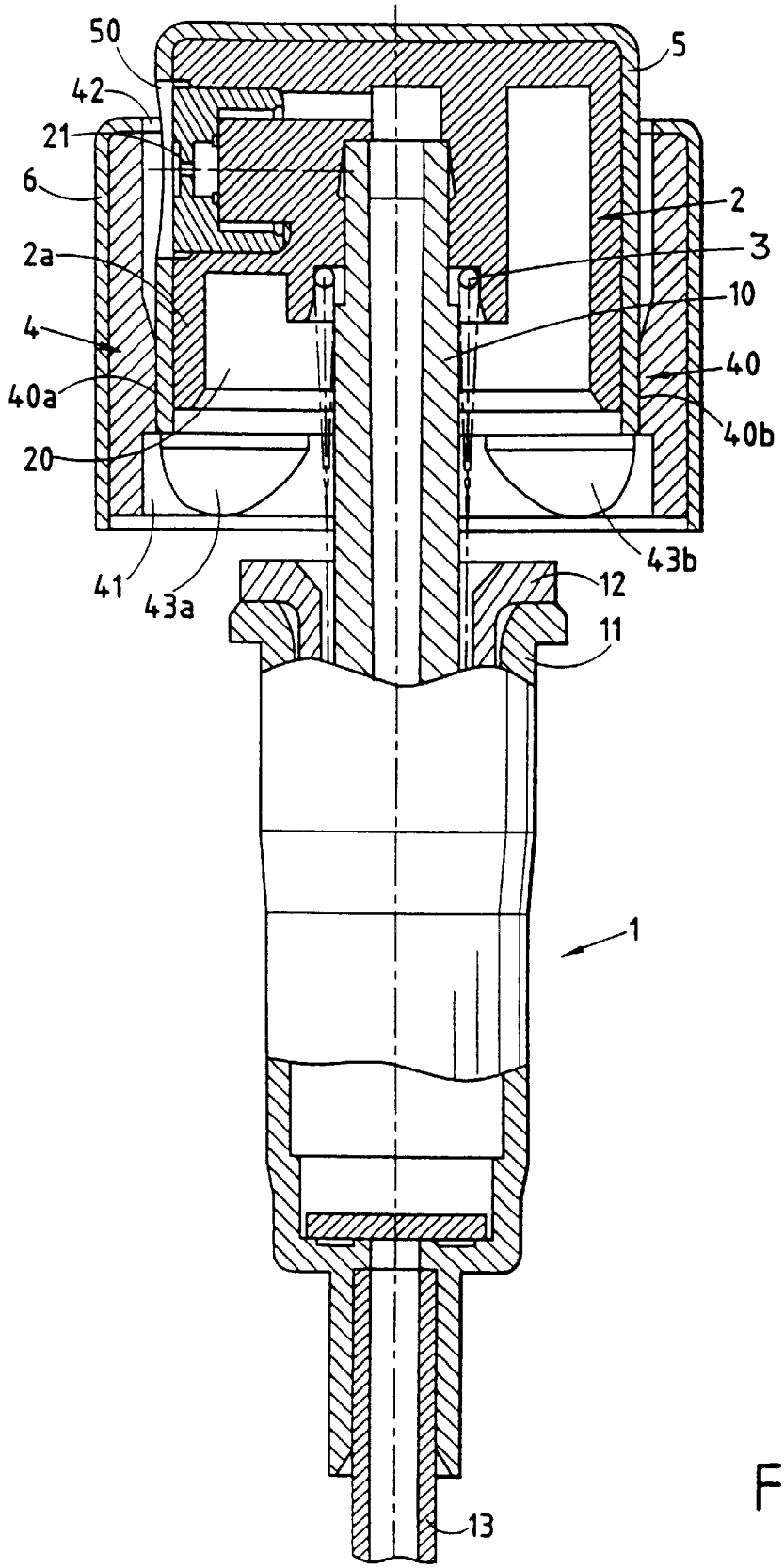
FIG. 1 is a section view of an embodiment of the device of the invention.
Figures 2A, 2B, 2C, 2D:
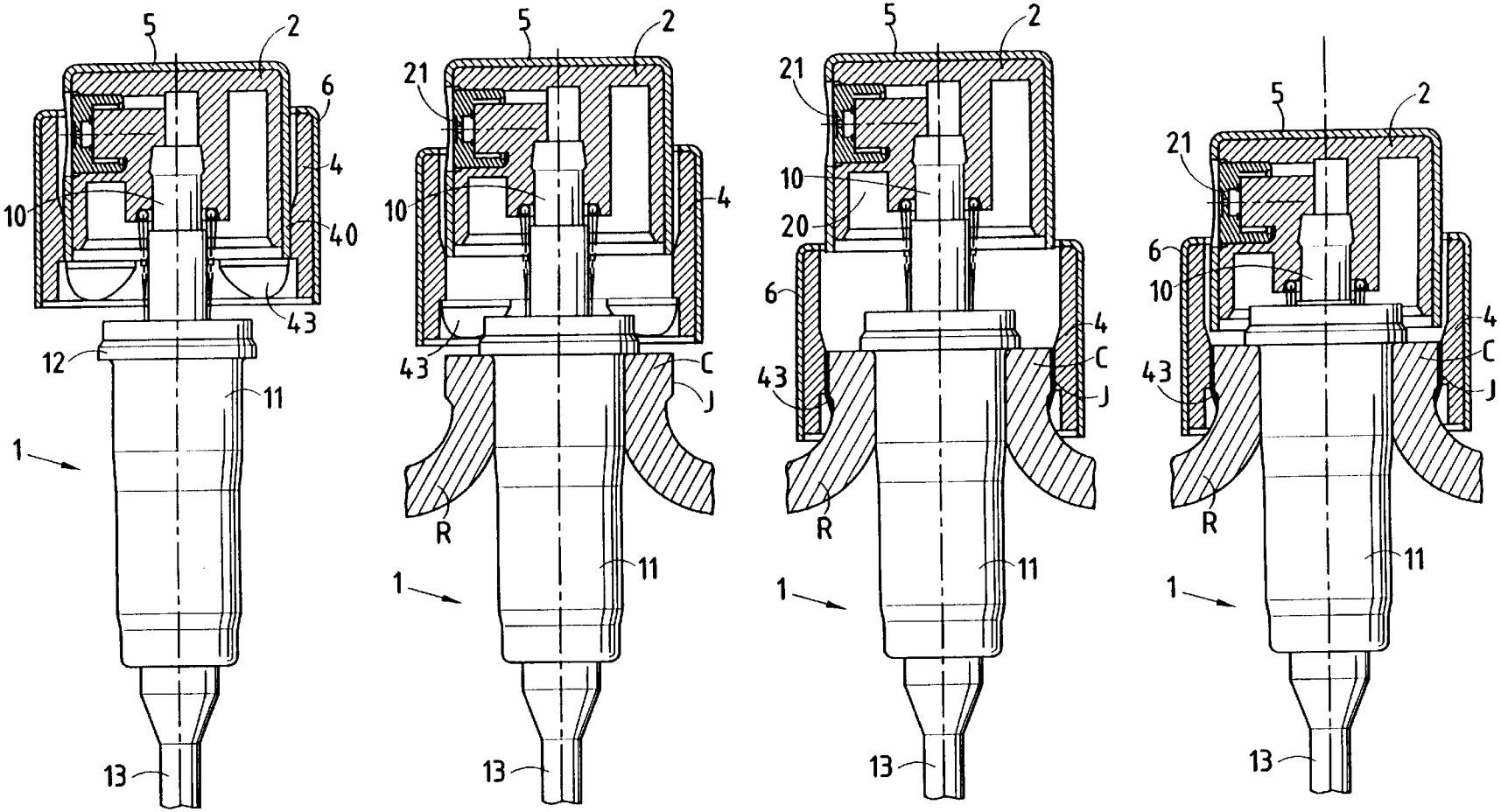
FIGS. 2A, 2B, 2C, and 2D are section views of the embodiment of FIG. 1 respectively in a pre-assembly position, a during-assembly position, a post-assembly position at rest, and a post-assembly position in operation.

The device shown in FIG. 1 is designed to dispense a liquid from a tank R provided with a neck C (shown only in FIGS. 2A and 2B.

The device comprises a pump 1 provided, in particular, with a cylindroconical body 11 that defines an internal measuring chamber and that is suitable for being clamped in the neck C of the tank R, a conventional internal mechanism (not shown), and a liquid inlet tube 13.

The body 11 of the pump 1 is terminated, in its top portion, by a shoulder or plate 12 having dimensions that are determined once and for all in order to match the dimensions of the tanks to be fitted.

The pump 1 also comprises a spray tube 10 that projects out from the body 11 and is capped by a pushbutton 2 fitted here with a spray nozzle 21.

The pushbutton co-operates with resilient return means such as a helical spring 3 disposed around the tube 10 and bearing via its bottom portion on the body 11 of the pump.

The device also comprises a collar 4 for covering the pump 1. The collar 4 is constituted by a substantially cylindrical skirt provided with a bottom opening 41 in which the neck C of the tank R is engaged, and a top opening 42 through which the pushbutton 2 passes.

The collar 4 is thus fastened, in a low position, on the neck C of the tank R, thereby partially masking the body 11 of the pump 1, as shown in FIG. 2C.

The collar 4 includes, on its inside face, projecting members 40 that enable said collar to be held temporarily in a high position by radial clamping on the outside face of the pushbutton 2.

This disposition enables the collar 4 and the pump 1 to be held together temporarily via the pushbutton 2 in order to form a unit that is ready for assembly.

In this case, the projecting members 40 are constituted by at least two pairs of diametrically opposite bumps 40*a*, 40*b* each having an internal contact face that is at least partially cylindrical and that is substantially parallel to the facing outside face of the pushbutton 2.

The pushbutton 2 is provided with a bottom cavity 20 giving its side wall 2*a* the ability to deform elastically.

Where appropriate, the outside of the pushbutton 2 is sheathed in a sheath 5 made of a material, e.g. metal, such that its coefficient of friction with the projecting members 40 enables the collar 4 to be held in a high position without any sliding. The sheath 5 is provided with a side orifice 50 in register with the nozzle 21.

The diameter of the collar 4 and the dimensions of the projecting members 40 are determined as a function of the outside diameter of the pushbutton 2, the thickness of the sheath 5, and the capacity of the wall 2*a* of the pushbutton to deform under compression, with a view to obtaining sufficient radial clamping force to ensure that the collar 4 is held stably in a high position.

The outside of the collar 4 may be sheathed in a sheath 6 which, for reasons of appearance, is preferably made of the same material as the sheath 5 of the pushbutton 2.

The collar 4 also includes snap-fastening members 43 designed to co-operate with a peripheral rim J formed on the neck C of the tank R, as shown in FIGS. 2A and 2B.

The snap-fastening members 43 are constituted by at least two, and in this case four, catches 43*a*, 43*b* carried by the inside face of said collar 4.

The snap-fastening members 43 are angularly offset relative to the projecting members 40.

In FIG. 2A, the device is shown with the collar 4 held in a high position by radial clamping on the pushbutton.

In that position, the pushbutton is fully received inside the collar 4, thereby ensuring mechanical protection, in particular of the nozzle 21.

In FIG. 2C, the device is shown with the collar 4 fastened, by snap-fastening, on the rim J of the neck C of the tank R.

Transfer from the preassembled position of FIG. 2A to the assembled position of FIG. 2C is performed firstly by fixing the body 11 of the pump 1 in the neck C of the tank R, and then by exerting axial thrust on the collar 4 towards the tank R, while retaining the pushbutton in its rest position, as shown in FIG. 2B.

The thrust has the effect of displacing the collar 4 downwards in guided manner over the pushbutton 2 by causing the projecting members 40 to slide over the outside face of the sheath 5 (or of the pushbutton 2).

Once the projecting members 40 become disengaged from the pushbutton 2, the collar is free and is brought into contact with the neck C of the tank R.

Additional axial force then enables the final snap-fastening of the members 43 under the rim J of the neck.

In the assembled position in FIG. 2C, the projecting members 40 are thus facing the rim J, while leaving a small amount of clearance to exist therebetween.

Subsequently, manually pressing the top face of the pushbutton 2 causes the tube 10 to move down and, by actuating the pump mechanism, a dose of liquid is expelled and sprayed from the nozzle 21. As shown in FIG. 2D, the height of the collar 4 is determined as a function of the stroke of the pushbutton 2 so that at the end of its stroke the nozzle 21 is not covered by said collar, not even in part.

What is claimed is:

1. A device for dispensing a liquid from a tank (R), the device comprising:

firstly a pump (1) provided in particular with a cylindro-conical body (11) that is suitable for being fixed in a neck (C) of the tank (R), and a spray tube (10) that projects out from the body (11) and is capped by a pushbutton (2); and secondly a collar (4) for covering the pump (1) and fastened in a low position on the neck (C) of the tank (R), the device being characterized in that said collar (4) includes, on its inside face, projecting members (40) that enable said collar to be held temporarily in a high position by radial clamping on the outside face of the pushbutton (2).

2. A device according to claim 1, characterized in that said projecting members (40) are constituted by at least two diametrically opposite bumps (40*a*, 40*b*) each having a contact face that is at least partially cylindrical and that is substantially parallel to the facing outside face of the pushbutton (2).

3. A device according to claim 1, characterized in that the outside of the pushbutton (2) is sheathed in a sheath (5) made of a material such that its coefficient of friction with the projecting members (40) enables the collar (4) to be held.

4. A device according to claim 1, characterized in that said collar (4) includes snap-fastening members (43) designed to co-operate with a peripheral rim (J) formed on the neck (C) of the tank (R).

5. A device according to claim 4, characterized in that said snap-fastening members (43) are constituted by at least two catches (43*a*, 43*b*) carried by the inside face of said collar (4).

6. A device according to claim 4, characterized in that said snap-fastening members (43) are angularly offset relative to the holding members (40).

7. A device according to claim 1, characterized in that the outside of the collar (4) is sheathed in a sheath (6).

* * * * *